United States Patent [19]

Holmberg

[11] Patent Number: 4,921,404

[45] Date of Patent: May 1, 1990

[54] PROPELLORS FOR WATERCRAFT

[76] Inventor: Arnold C. V. Holmberg, 29 David Low Highway, Mudjimba, Queensland, 4564, Australia

[21] Appl. No.: 882,936

[22] PCT Filed: Oct. 14, 1985

[86] PCT No.: PCT/AU85/00246

§ 371 Date: Jun. 12, 1986

§ 102(e) Date: Jun. 12, 1986

[87] PCT Pub. No.: WO86/02331

PCT Pub. Date: Apr. 24, 1986

[30] Foreign Application Priority Data

Oct. 12, 1984 [AU] Australia ..... PG7616
Jan. 9, 1985 [AU] Australia ..... PG8825

[51] Int. Cl.[5] ..... B63H 1/26
[52] U.S. Cl. ..... 416/223 R; 416/243
[58] Field of Search ..... 416/223 R, DIG. 2, 243, 416/176, 242, 234

[56] References Cited

U.S. PATENT DOCUMENTS

| | | | |
|---|---|---|---|
| 1,019,437 | 3/1912 | Draper | 416/243 |
| 1,358,430 | 11/1920 | Faehrmann | 416/144 |
| 1,455,591 | 5/1923 | Lawson | 416/223 R |
| 1,543,261 | 6/1925 | Hickmann | 416/176 |
| 2,087,243 | 7/1937 | Caldwell | 416/176 |
| 2,667,936 | 2/1954 | Clark | 416/223 R |
| 3,635,590 | 1/1972 | Phillips | 416/223 R |
| 4,632,636 | 12/1986 | Smith | 416/223 R |

FOREIGN PATENT DOCUMENTS

| | | |
|---|---|---|
| 146521 | 4/1921 | Australia . |
| 133325 | 11/1899 | Fed. Rep. of Germany . |
| 412638 | 11/1922 | Fed. Rep. of Germany . |
| 87955 | 12/1951 | Norway . |
| 28941 | 4/1909 | Sweden . |
| 8568 | of 1909 | United Kingdom . |
| 208462 | 12/1928 | United Kingdom . |
| 333476 | 8/1930 | United Kingdom . |
| 1163549 | 9/1969 | United Kingdom . |

*Primary Examiner*—Robert E. Garrett
*Assistant Examiner*—Joseph M. Pitko
*Attorney, Agent, or Firm*—Larson & Taylor

[57] ABSTRACT

A propellor (10) for watercraft has a hub (11) with a pair of blades (12) with a leading portion (13) central portion (14) and trailing portion (15). The leading portion (13) of the blades are forwardly inclined relative to the hub (11) and the blades progress through the generally radial central portion (14) to the rearwardly inclined trailing portion (15), the radial height of the blades decreasing from the central portion (14) to the trailing portion (15). Both the peripheral pitch of the blades (12), and the pitch of the line of junction (16) of the blades (12) to the hub (11) increase along the propellor (10), at least from the central portion (14) to the trailing portion (15).

6 Claims, 2 Drawing Sheets

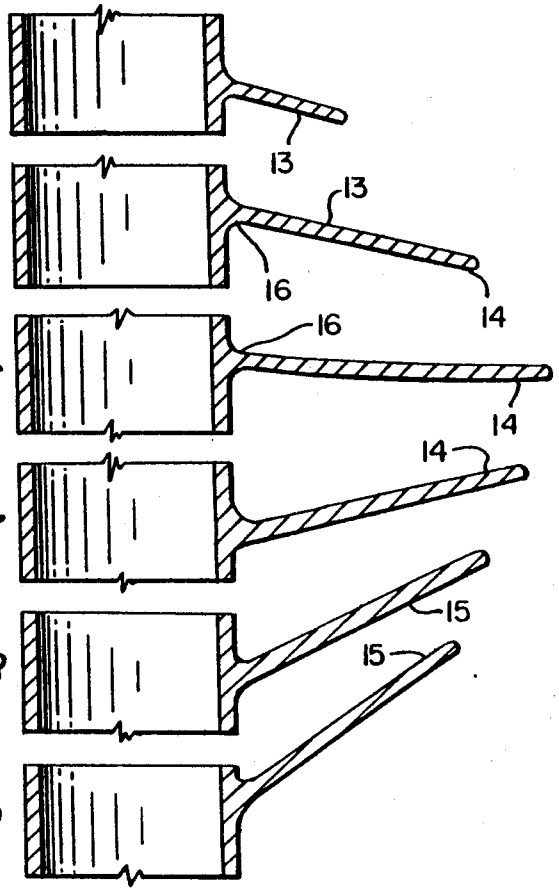
FIG. 4 FIG. 5 FIG. 6 FIG. 7 FIG. 8 FIG. 9
FIG. 3
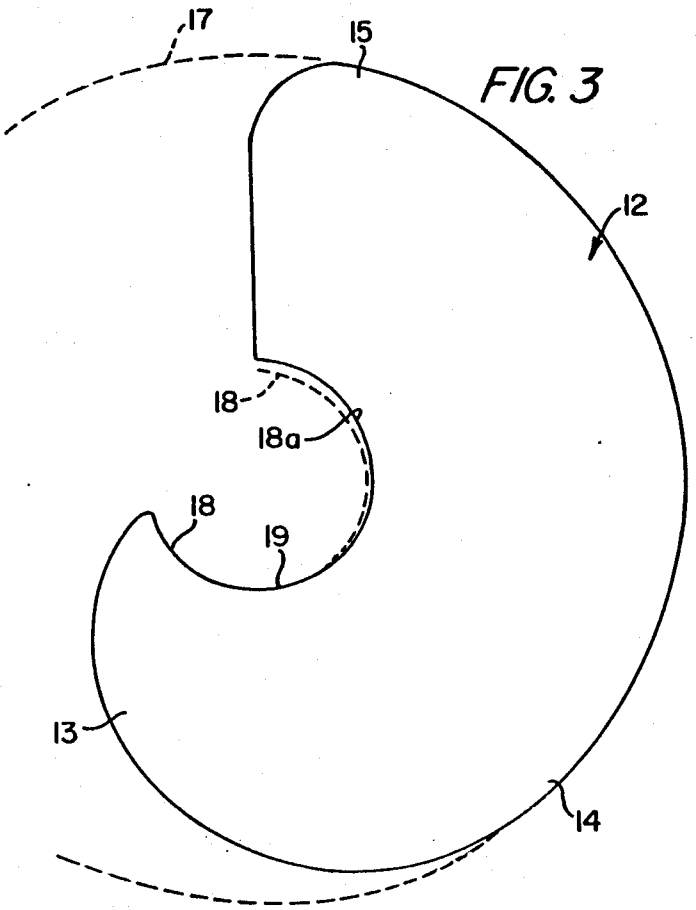

PROPELLORS FOR WATERCRAFT

BACKGROUND OF THE INVENTION (1) Field of the Invention

This invention relates to propellors for watercraft. The term "propellors" shall also include marine screws and like propulsion units.

(2) Prior Art

Conventional propellors have two or more blades fitted to a hub and set at a pitch angle selected as most appropriate for the intended application. The propellors produce a divergent cone of thrust which reduces their efficiency, as the thrust is dissipated in the surrounding water and they also produce a "cocktail" or "roostertail" spray above the waterline, especially at higher speeds, indicating that potential thrust energy has been wasted. The divergent coning effect has been partially eliminated by producing shrouded or ringed propellors but these generate increased turbulence and suffer increased drag. Finally, the known propellors produce very little, if any, reverse thrust which can be used to reverse or brake the vessel to which the propellors are fitted.

Various types of propellors have been proposed. For example, U.S. Pat. No. 2,087,243 (Caldwell) discloses a propellor of convergent radial height along the propellor, where the forward portion of each blade is forwardly inclined and the rearward portion is rearwardly inclined and where the line of junction of the blade with the hub is "a regular spiral of a given pitch, the peripheral pitch of the blade being greater than that of the junction line". United Kingdom Patent No. 8568 of 1909 (Marks) discloses a propellor where the peripheral pitch of the blade increases along the propellor and the radial height of the blade increases in height along the propellor.

Even these propellors have not proved satisfactory in overcoming the problems with the known propellors discussed above.

SUMMARY OF THE PRESENT INVENTION

It is an object of the present invention to provide a propellor which generates greater thrust than a conventional propellor of similar dimensions.

It is a preferred object to provide a propellor which can generate a large braking effect e.g. upto 50% reverse thrust.

It is a further preferred object to provide a propellor which creates less turbulence, the propellor producing a convergent cone of thrust.

It is a still further preferred object to provide a propellor which can provide a higher vessel speed for a given propellor speed.

Other preferred objects of the present invention will become apparent from the following description.

In one aspect the present invention resides in a propeller for watercraft including:

a hub connectable to a drive shaft; and a plurality of blades attached to the hub, each blade having a leading portion, a central portion and a trailing portion, wherein:

the line of junction between at least the central and trailing portions of the blades with the hub is of increasing pitch along the hub.

Preferably the leading portion of each blade is forwardly inclined relative to the hub, and the trailing portion of each blade is rearwardly inclined relative to the hub. Preferably the central intermediate portion of the blade, approximately 70°-110° from the leading portion, extends substantially radially to the hub.

Preferably the peripheral pitch of the blades increases along the propellor more preferably from the central or intermediate portion to the trailing portion of the blades.

Preferably the radial height of the blades increases from the leading portion to the central or intermediate portion, where the radial height is a maximum, and the radial height of the blades then decreases to the trailing portion.

Preferably, in side view, the leading portion of each blade has a configuration of an aerofoil and the trailing portion has a configuration of an aerofoil to generate low pressure areas in the water through which the propellor is passing.

Preferably each blade extends around the hub for 180° to 270°, more preferably approximately 220°.

BRIEF DESCRIPTION OF THE DRAWINGS

To enable the invention to be fully understood, a preferred embodiment will now be described with reference to the accompanying drawings, in which:

FIG. 3 is a plan view of a blade cut out from a plate before fabrication; and FIGS. 4 to 9 are respective sectional views of a blade taken on lines 4—4 to 9—9 respectively on FIG. 2.

DETAILED DESCRIPTION OF THE PREFERRED EMBODIMENT

Figure 1:
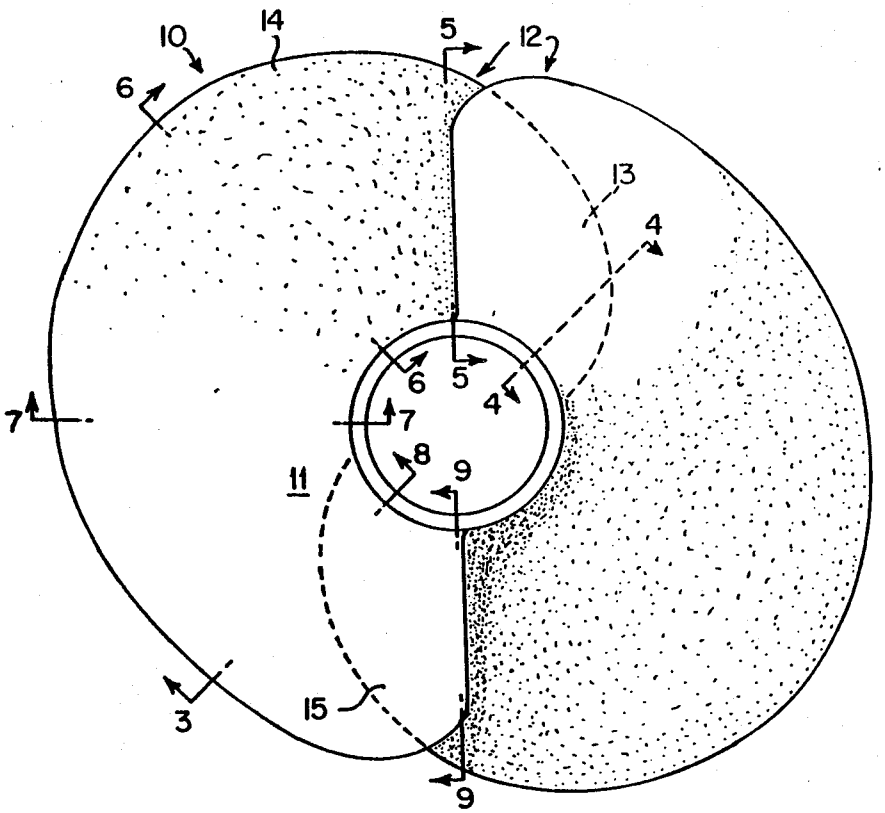
FIG. 1 is a side view of the propellor.
Figure 2:
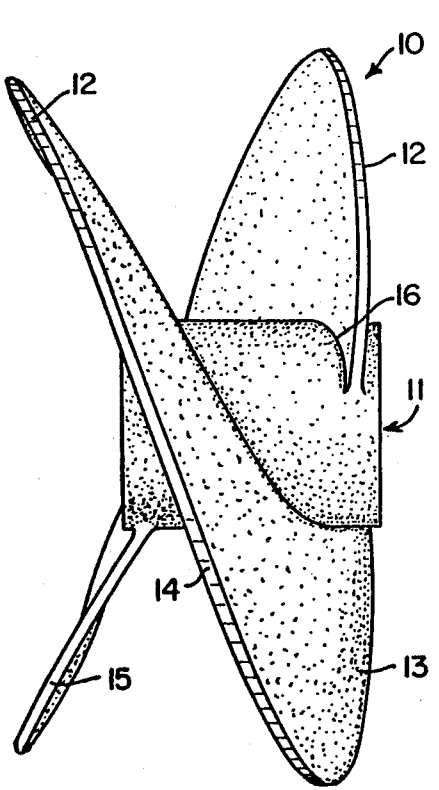
FIG. 2 is a rear end view of the propellor, parts being shown in dashed lines for clarity.

The propellor 10 has a hub 11 which may be engaged directly to the drive shaft of a vessel or be fitted with a splined driving hub for engagement with the drive shaft.

A pair of blades 12 are provided around the hub 11 for approximately 220° of rotation and each blade has a leading portion 13, central or intermediate portion 14 and a trailing portion 15. The leading portion 13 of each blade has a curved leading edge of increasing peripheral height, the leading edge being relatively "blunt" compared with the tapered leading edge of conventional propellors. The leading portion is forwardly inclined relative to the hub (see FIGS. 4 and 5) and is curved to have the configuration of a aerofoil to create a low pressure area on the surface of that portion of the blade.

The central portion 14 of the propellor commences at approximately 70°-90° rotation of the blade and attains the maximum radial height of the blade at approximately 90°-110° of rotation. The central portion 14 progressively changes in inclination relative to the hub from forwardly inclined (see FIG. 5), to substantially radial to the hub (see FIG. 6), to rearwardly inclined (see FIG. 7).

The radial height of the blade progressively decreases from the central portion 14 to the trailing portion 15, the latter portion of the blade being rearwardly inclined relative to the hub (as shown in FIGS. 8 and 9).

The trailing portion 15 has a configuration in side view of a high speed airfoil to generate a low pressure area on the front face of that portion of the blade, that low pressure area being adjacent to, and downstream of the low pressure area generated on the rear face of the leading portion 13 of the other blade.

The pitch of the line of junction 16 of the blades 12 to the hub 11 increases along the hub, at least from the central portion 14 to the trailing portion 15 e.g. over the range of 70°–110° rotation to 220° rotation to form a divergent "throat" between the blades along the propellor.

In various tests, it has been found that the propellor produces a convergent cone of thrust, with very little spray even at high speeds, and that the propellor produces greater thrust than conventional propellors of the same diameter. (On one test, a 40cm. diameter propellor of the present invention was fitted to a vessel in replacement for a damaged 63cm. propellor on the vessel and developed approximately the same thrust). It is believed that the improved performance of the propellors of the present invention is due to the aerofoil configurations of the blades which tend to "suck" the water into the propellor which the divergent "throat" between the blades, due to the increase in pitch of the line of junction of the blades to the hub, prevents the propellor from "choking".

The low pressure areas generated by the aerofoil configurations of the blades at the "inlet" and "outlet" to the divergent throat assist in drawing the water through the propellor.

In addition to the increased forward thrust, the propellors in test have demonstrated a reverse thrust which is upto 50% of the forward thrust. This reverse thrust is much greater than that found with conventional propellors which often have reverse thrusts in the range of 0%–10% of the forward thrust. It is believed that the improved reverse thrust is due to the aerofoil configuration of the blades which also create the low pressure areas within the propellors when in reverse.

The propellors may be cast to the desired shape or may be fabricated, with the blades formed from a sheet of steel or aluminium.

To enable the fabrication of the propellor to be readily understood, reference is now made to FIG.3.

An annular piece of metal is cut out, with an outer radius 17 substantially equal to the maximum radial height of the blade (in the central portion 14) and an inner radius 18 just greater than the outer radius of the hub 11.

A portion of the sheet is removed to leave a blade of approximately 220° rotation about the hub. At approximately 90° from the leading edge (i.e. at point 19), the inner radius of the sheet is increased progressively from the central portion 14 to the trailing portion 15 where the effective inner radius 18a is determined by the formula $$R=r+a(b/c)$$

where:

r=inner radius for body portion (indicated by line 18)

R=effective inner radius of the central and trailing portions (indicated by line 18*a*)

a=radius increase ratio b=the angular distance from the trailing edge less the angular distance from point 19 to the leading edge (e.g. 90°)

c=angle factor (e.g. 40°–45°)

For example $$R=r+1.6\ (b/45)$$

Therefore, at the trailing edge of the 220° blade, $$R=r+1.6\ (130/45)$$

At the trailing edge, the effective inner radius R is approximately 4–4.5 mm. greater than the radius of the leading portion where the effective radius is increased by approximately 1.6 mm. (1/16 inch) for each 45° around the hub from point 19.

The central portion 14 is attached to the hub 11 and the blade 12 is progressively wound around the hub towards the trailing edge. As the effective inner radius R is increased relative to the outer radius of the hub 11, the blade must be pulled rearwardly to draw the blade into engagement with the hub. This increases the pitch of the line of junction of the blade with the hub, while simultaneously reducing the peripheral height of the blade, increasing the peripheral pitch of the blade and causing the rearward inclination of the blade to be increased towards the trailing edge (see FIGS. 6–9). The leading portion of the blade is then attached to the hub and the blade is bent forwardly to enable the tip of the leading edge to be attached to the hub. The forward inclination of the blade is shown in FIGS. 4 and 5.

Comparative tests using conventional propellors and propellors of the present invention on the same marine engines have noted the following improvements in the propellors of the present invention:

1. When the throttle is pushed fully open, the present propellor does not "race" but drives the watercraft as it runs upto full speed and it achieves full speed in approximately two-thirds the distance the craft is driven by the conventional propellor.

2. The maximum speed of the watercraft may be 10–30% higher.

3. In rough water, the propellor does not tend to come out of the water and does not tend to overrun.

4. At speed, the watercraft tends to plane flatter over the water i.e. the stern rides higher in the water.

5. In sharp turns, the craft tends to heel over like an aircraft and the stern does not tend to skid out.

6. If the engine is shut off, a strong braking effect is noted and in reverse, powerful reverse thrust is obtained (and water may be drawn over the transom as the craft is reversed).

7. The "cocktail" effect is reduced or minimised and the water behind the propellor appears to be "solid" with little wash.

8. It is observed that the water appears to be moving before it enters the propellor as though it is being sucked into the propellor, possibly due to the aerofoil like portions of the blades.

9. The "blunt" peripheral edge of the blades is less liable to damage by chipping or breaking when striking rocks or other submerged objects.

The specific configuration of the propellor e.g. number, shape, diameter, length, pitch and inclination of the blades can be selected to suit the particular intended application.

Various changes and modifications may be made to the embodiments described without departing from the scope of the present invention as defined in the appended claims.

I claim:

1. A propellor for watercraft including:

a hub connectable to a drive shaft; and a plurality of blades attached to the hub, each blade having a leading portion, a central portion and a trailing portion, wherein:

the line of junction between at least the central and trailing portions of the blades with the hub is of increasing pitch along the hub;

the leading portion of each blade is inclined forwardly relatively to the hub;

the trailing portion of each blade is inclined rearwardly relatively to the hub;

the central portion extends substantially radially to the hub; and the blades are substantially coextensive along the length of the hub and are disposed in relatively inverted, overlapping relationship wherein the leading portion of one blade partially overlaps the trailing portion of the other blade to form a divergent throat between the blades along the propellor to prevent the propellor from choking with water.

2. A propeller as claimed in claim 1 wherein:

the radial height of the blades increases from the leading portion to a maximum radial height at the central portion and then decreases to the trailing portion.

3. A propellor as claimed in claim 1 wherein:

the leading portion of each blade has a configuration of a aerofoil and the trailing portion has a configuration of an aerofoil to generate low pressure areas in the water to draw the water into the propellor.

4. A propellor as claimed in claim 4 wherein:

5. A propellor for watercraft including:

a hub connectable to a drive shaft;

a plurality of blades attached to the hub, each blade having a leading portion, central portion and trailing portion wherein:

the leading portion of each blade is inclined forwardly to the hub and leads progressively into a central portion which is substantially radial to the hub and then into a trailing portion which is inclined rearwardly relatively to the hub;

the peripheral pitch of the blades increases along the hub from the leading portion to the trailing portion and the radial height of the blades increases along the hub from the leading portion to the trailing portion;

the leading and trailing portions both have the configuration of aerofoils to generate low pressure areas in the water to draw the water into the propellor;

the line of junction of at least the central and trailing portions of the blades with the hub is of increasing pitch along the hub;

the blades are substantially coextensive along the length of the hub and are disposed so as to form a divergent throat between the blades; and the aerofoil on the leading portion of the blade is on the opposite side of the blade to the aerofoil on the trailing portion of the blade, the aerofoil on the leading portion operating to generate low pressure area in the inlet to the divergent throat formed between the blades and the aerofoil on the trailing portion operating to generate a low pressure area at the outlet of the divergent throat.

6. A propellor as claimed in claim 1 or claim 3 wherein:

the peripheral pitch of the blades increases along the propellor from the central to the trailing portion of the blades.

* * * * *

UNITED STATES PATENT AND TRADEMARK OFFICE

CERTIFICATE OF CORRECTION

PATENT NO. : 4,921,404

DATED : May 1, 1990

INVENTOR(S) : Holmberg

It is certified that error appears in the above-identified patent and that said Letters Patent is hereby corrected as shown below:

Column 5, line 34, delete entire line and insert therefor Claim 4 as follows:

"4. A propellor as claimed in claim 1 wherein: the central portion commences 70-110° of rotation after the leading edge of the blades."

Signed and Sealed this

Nineteenth Day of May, 1992

*Attest:*

DOUGLAS B. COMER

*Attesting Officer*

*Acting Commissioner of Patents and Trademarks*